United States Patent [19]

Whitten, Jr.

[11] 3,945,061

[45] Mar. 23, 1976

[54] SWIMMING POOL INLET FITTING ASSEMBLY

[76] Inventor: George R. Whitten, Jr., 11 Highland Ave., Bellingham, Mass. 02019

[22] Filed: Dec. 13, 1974

[21] Appl. No.: 532,494

[52] U.S. Cl. ..... 4/172.17; 285/206

[51] Int. Cl.[2]... E04H 3/16; E04H 3/18; F16L 21/02

[58] Field of Search ..... 4/1, 114, 172, 172.15, 4/172.17, 172.18; 285/19, 20, 161, 158, 206, 208, 209, 239

[56] References Cited

UNITED STATES PATENTS

| | | | |
|---|---|---|---|
| 2,281,882 | 5/1942 | Kinsman | 285/206 |
| 3,749,424 | 7/1973 | Greene | 4/172 |

*Primary Examiner*—Houston S. Bell, Jr.

*Attorney, Agent, or Firm*—Thompson, Birch, Gauthier & Samuels

[57] ABSTRACT

For use with a drain gutter and water supply assembly of the type which is adapted to be positioned along the periphery of a swimming pool, with an inner gutter wall over which contaminated water is allowed to spill continuously into the gutter from the surface of the pool, and with a filtered water supply manifold contained in the gutter, an adjustable inlet fitting assembly for directing filtered water from the supply manifold through the inner gutter wall into the pool. The fitting assembly includes a flanged male member adapted to extend through an opening in the gutter wall, a flanged female member received on the male member and adapted to cooperate therewith in gripping the gutter wall therebetween, and a locking member in threaded engagement with the male member for retaining the male and female members in the aforesaid cooperative relationship. The fitting assembly further includes a flexible pipe or the like connected at opposite ends respectively to the supply manifold and the male member.

9 Claims, 5 Drawing Figures

SWIMMING POOL INLET FITTING ASSEMBLY

BACKGROUND OF THE INVENTION

This invention relates generally to a drain gutter and water supply assembly of the type which is adapted to be positioned along the periphery of a swimming pool, with an inner gutter wall over which contaminated water is allowed to spill continuously into the gutter from the surface of the pool, and with a filtered water supply manifold contained in the gutter. In installations of this type, inlet fitting assemblies are employed to direct filtered water from the supply manifold through the inner gutter wall into the pool at selected locations beneath the pool surface. In this way, the contaminated water continuously being received in the gutter is continuously replaced by filtered water, and the surface level of the pool is maintained relatively constant. Both the gutter and the supply manifold are connected in a known manner to pump and filtering means to provide a closed circulating system, with additional means provided to add make-up water when needed.

A primary object of the present invention is the provision of a novel and improved inlet fitting assembly which is adjustable to enable the incoming flow of filtered water to be directed in a manner which insures proper distribution and an efficient circulating flow pattern for each pool installation. Although devices for this purpose are currently available, an example of which is the device shown in U.S. Pat. No. 3,578,023, such devices are unsatisfactory because they are inconvenient to manipulate, difficult to disassemble when removal of the main supply conduit is necessitated, and also because they are characterized by a high head loss due to the internal directional changes in flow which the water experiences as it passes through such devices.

It is, accordingly, a further object of the present invention to obviate the aforementioned problems by providing an inlet fitting assembly which is not only adjustable, but also which is capable of being quickly and easily assembled and disassembled, and also characterized by a low head loss.

Still another object of the present invention is the provision of an inlet fitting assembly which embodies a minimum number of components capable of being easily assembled and adjusted to obtain a desired flow direction for the incoming filtered water.

SUMMARY OF THE INVENTION

According to the present invention, an inlet fitting assembly is provided for mounting on the inner wall of a drain gutter and water supply assembly. The assembly includes a tubular male member having a smooth-walled passageway extending therethrough. The outlet end of the male member is provided with an external radial flange. The male member is adapted to protrude inwardly through an opening in the inner gutter wall, with the external flange surrounding the opening and in contact with the exterior surface of the gutter wall. A female member having an integral internal flange is received on the male member. The internal flange is adapted to surround the wall opening and to contact the interior wall surface. When thus assembled, the internal and external flanges are disposed oppositely to each other on opposite sides of the gutter wall. A locking member which is engageable with both the male and female members, provides the means for drawing the aforesaid flanges together to grip the gutter wall therebetween. The assembly is completed by a flexible pipe, tube or the like connected at opposite ends respectively to the supply manifold and the male member. The smooth-walled passageway of the male member cooperates with the flexible pipe to tube to direct water from the supply manifold into the pool with a minimum head loss. The direction of the incoming flow of water can be changed by simply loosening the locking member sufficiently to permit rotation of the male and female members relative to the gutter wall and thereafter again tightening the locking member. The entire assembly is thus made up of a minimum number of components which can be easily and quickly disassembled when pool maintenance and/or repair is required.

BRIEF DESCRIPTION OF THE DRAWINGS

An embodiment of the invention will now be described by way of example only, with reference to the accompanying drawings, wherein.

DESCRIPTION OF PREFERRED EMBODIMENT

Figure 1:
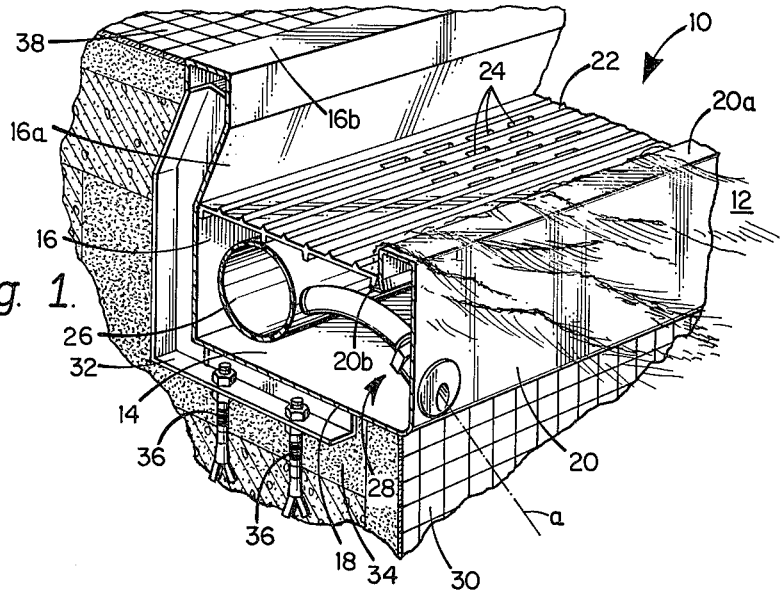
FIG. 1 is a partial perspective view with portions broken away of a drain gutter and water supply assembly having associated therewith an inlet fitting assembly embodying the concepts of the present invention.

With reference to the drawings, there is generally indicated at 10 a typical drain gutter and water supply assembly of the type with which the present invention may be employed. The assembly 10 is adapted to be positioned around the periphery of a swimming pool 12. The assembly includes an elongated gutter 14 which is formed by an exterior wall 16, a bottom 18 and an interior wall 20. The upper portion of the interior wall 20 is suitably shaped to form an upper lip **20*a* with a downturned portion terminating in a horizontal flange 20*b*. The exterior wall 16 has support brackets (not shown) which cooperate with the flange 20*b* to support removable cover sections 22, the latter being perforated as at 24. Contaminated water is skimmed continuously from the surface of the pool 12 and is allowed to flow over the lip 20*a* onto the cover sections 22, where it drops through the perforations 24 into the gutter 14. From here, the contaminated water is received and pumped in a known manner through a filtering system (not shown) after which it is returned as filtered water through an inlet manifold 26. A fitting assembly in accordance with the present invention and generally indicated at 28 is employed to convey the filtered water from the supply manifold 26 through the inner gutter wall 20 into the pool 12.**

While not essential to an understanding of the present invention, it will be appreciated that the inner gutter wall 20 is preferably vertical and parallel to the pool wall 30. The gutter wall 20 may be flush with pool wall 30, or it may jut out slightly as shown in the drawings. The gutter bottom 18 is supported by brackets 32 which are anchored on a recessed ledge 34 of the pool wall by bolts 36. The exterior gutter wall 16 is inclined upwardly and inwardly as at 16*a* and terminates in a horizontal ledge 16*b* which is flush with the floor 38 surrounding the pool.

Figure 3:
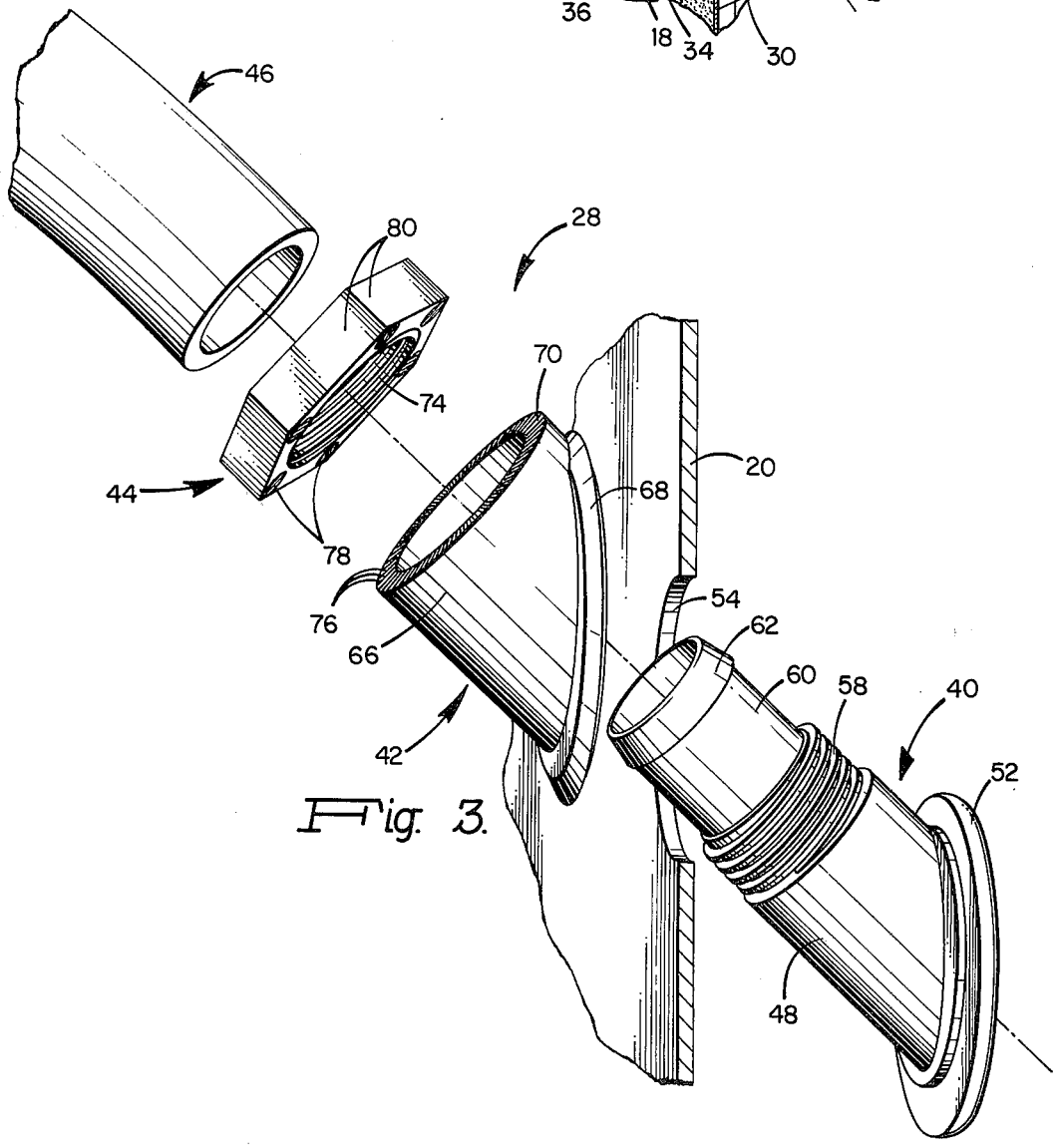
FIG. 3 is an exploded perspective view of the inlet fitting assembly.
Figure 2:
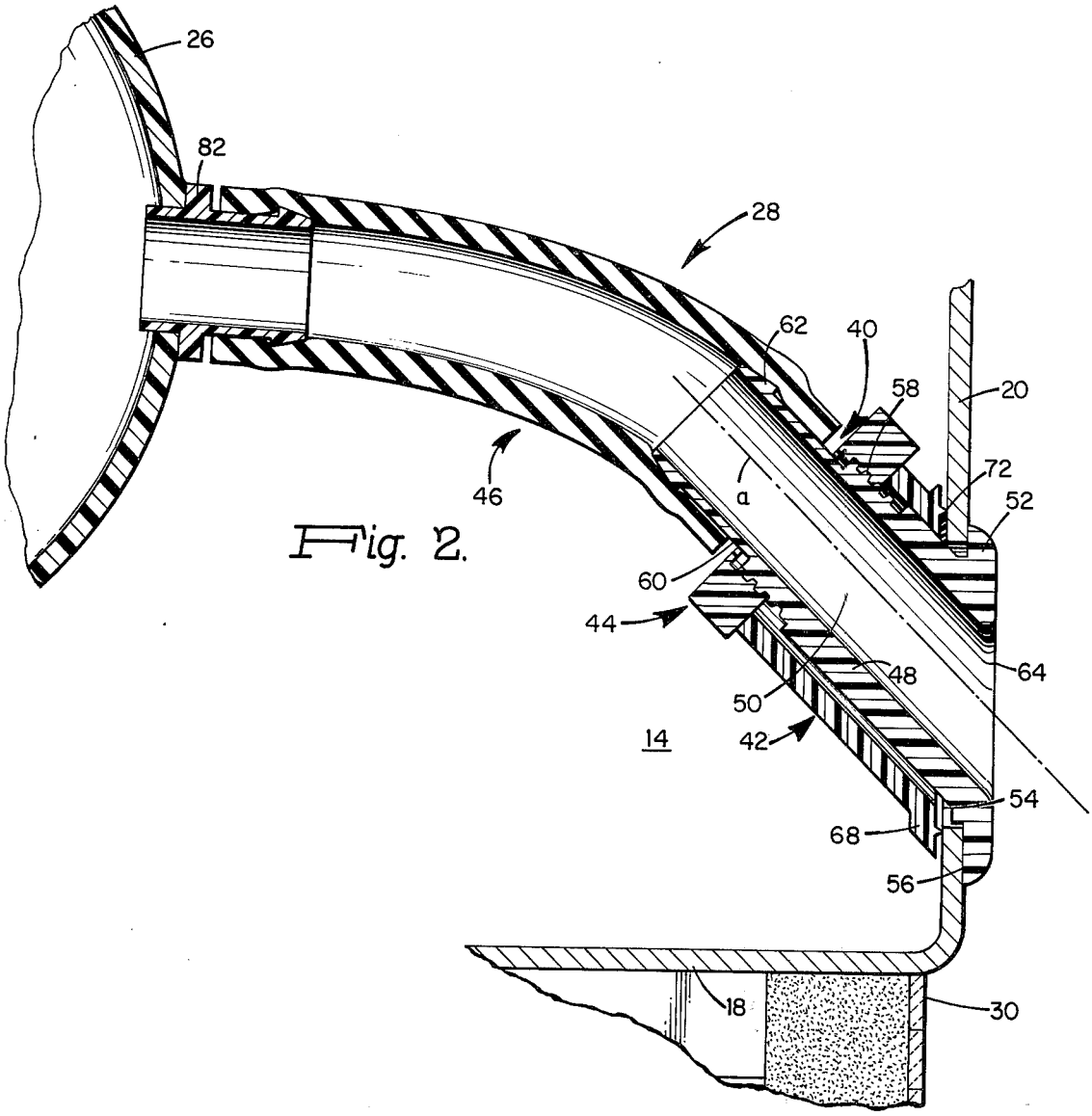
FIG. 2 is a longitidunal sectional view taken through the inlet fitting assembly shown in FIG. 1.

With reference in particular to FIGS. 2 and 3, it will be seen that the inlet fitting assembly 28 of the present invention includes a flanged male member 40, a flanged female member 42, a locking member 44 and a connecting conduit 46.

The male member 40 has a tubular body 48 with an internal smooth-walled passageway 50 extending axially therethrough. An external flange 52 is integrally formed at one end of the tubular body 48. The external flange 52 is adapted to surround an opening 54 in the inner gutter wall 20, and to contact the exterior surface of the wall as at 56. The axis *a* of the tubular body 48 and the passageway 50 extending therethrough is arranged at an angle relative to the gutter wall 20 and the flange 52. Thus, the tubular body 48 is adapted to protrude upwardly at the aforesaid angle through the opening 54 into the gutter 14. The external surface of the tubular body 48 is preferably provided with a threaded section 58 and a reduced diameter section 60 which terminates in a truncated conical collar 62. The outlet end of the passageway 50 is preferably shaped to provide an eliptical orifice 64.

The female member 42 has a tubular body 66 having an internal diameter which is larger than the maximum external diameter of the male member 40. An internal flange 68 is integrally formed at one end of the female member. The other end of the female member forms a face 70 which lies in a plane perpendicular to the axis of tubular body 66 and inclined relative to the plane of the internal flange 68. The female member is adapted to be received on the tubular body 48 of the male member 40, with its internal flange 68 surrounding the wall opening 54 and in contact with the interior surface of the gutter wall 20. The angular arrangement of the internal flange 68 relative to the axis of the tubular body 66 is such that when the male and female members are assembled as shown in FIG. 2, the external and internal flanges 52 and 68 will lie in opposed parallel planes on opposite sides of the gutter wall 20. Preferably, although not necessarily, the internal flange 68 may have a sharp circular ridge 72 arranged to engage the interior surface of the gutter wall 20.

The locking member 44 is internally threaded as at 74 and is adapted to be received on the male member 40 in threaded engagement with the external threaded section 58. When tightened, the locking member 44 acts on the male and female members to draw the external and internal flanges thereof together in a cooperative gripping relationship on the gutter wall 20 located therebetween. The end face 70 on the female member is provided with serrations 76 which are adapted to engage serrated spots 78 on the female member in order to assist in maintaining the female member in a tightened condition. The external surface of the female member 44 has flat faces 80 forming a hexagon to thereby facilitate its being tightened or loosened by a conventional wrench or other like tool.

The assembly is completed by connecting the conduit member 46 at its opposite ends respectively to the male member 40 and the inlet manifold 26. To this end, the manifold 26 has a standard fitting 82 which is insertable into one end of the conduit member 46. The opposite end of the conduit member is inserted over the collar 62 on the end of the male member. Because of the upward inclination of the tubular body 48 of the male member, and the fact that the opening 54 in gutter wall 20 is below the axis of the supply manifold 26, the connecting conduit member 46 will assume a downward curvature as shown in the drawings.

Figure 4B:
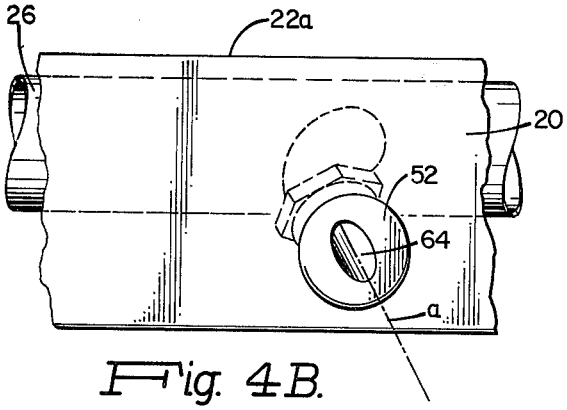
FIG. 4A is a front view of the inner gutter wall with the inlet fitting assembly adjusted to the position shown in FIGS. 1 and 2; and, FIG. 4B is a view similar to FIG. 4A with the inlet fitting assembly adjusted to a different position to vary the angle at which filtered water is directed into the pool.
Figure 4A:
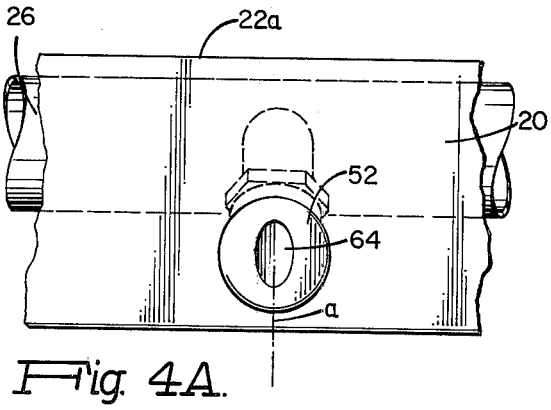

With the inlet fitting assembly in place and adjusted as shown in FIGS. 1, 2 and 4A, the flow of filtered water into the pool will be in the direction of the axis *a* of the passageway 50 through the male member 48. The flow of water through conduit member 46 and male member 40 will thus be guided by a smooth-walled substantially continuous passageway defined by the components 40 and 46, with a resulting minimum head loss. Should it be desired to adjust the flow pattern of the incoming filtered water, for example to obtain improved circulation and distribution in the pool, then it is only necessary to unscrew the female member 44 sufficiently to loosen the grip of the flanges 52 and 68 on the gutter wall. Then, the male member 40 can be rotated slightly about the axis of the wall opening 54 to a different position, as shown for example in FIG. 4B. The flexibility of conduit member 46 will accommodate such adjustments within a suitable range. Once the desired adjustment has been made, the locking member 44 is again tightened to secure the inlet fitting assembly in place. This adjustment cannot thereafter be altered inadvertently by swimmers in the pool. The entire fitting assembly is easily assembled, thus markedly facilitating initial installation. A minimum number of component parts are involved, and these can be molded of a relatively inexpensive material such as for example plastic or the like. The inlet fitting assembly may also be quickly and easily disassembled in the event that it becomes necessary to remove the supply manifold 26.

It is my intention to cover all changes and modifications to the embodiment herein chosen for purposes of disclosure which do not depart from the spirit and scope of the invention.

I claim:

1. For use with a drain gutter and water supply assembly of the type which is adapted to be positioned along the periphery of a swimming pool, with an inner gutter wall over which contaminated water is received into the gutter from the surface of the pool, and with a filtered water supply manifold contained in the gutter, the improvement comprising: an inlet fitting assembly for directing filtered water from said supply manifold through said gutter wall into said pool, said assembly including a flanged male member adapted to extend through an opening in said wall, a flanged female member slidably received on said male member and adapted to cooperate therewith in holding said gutter wall therebetween, a locking member threaded onto said male member and engageable with said female member for urging said male and female members into the aforesaid cooperative relationship, and a conduit member connected at opposite ends respectively to said supply manifold and said male member.

2. The apparatus as claimed in claim 1 wherein said conduit member is flexible.

3. For use with a drain gutter and water supply assembly of the type which is adapted to be positioned along the periphery of a swimming pool, the said assembly including an inner gutter wall having an upper lip over which contaminated water is received into the gutter from the surface of the pool, and a filtered water supply manifold contained in the gutter, and adjustable inlet fitting assembly for directing filtered water from the supply manifold through an opening in the gutter wall into the pool, said inlet fitting assembly comprising: an elongated tubular male member having an external flange at one end thereof which is adapted to surround said opening and to contact the exterior surface of said gutter wall, said male member being adapted to protrude inwardly through said opening into said gutter; a female member slidably received on said male member, said female member having an internal flange at one end thereof which is adapted to surround said opening and to contact the interior surface of said gutter wall; a locking member received on said male member in threaded engagement therewith, said locking member when tightened acting on said male member and the opposite end of said female member to urge said external and internal flanges together to grip said gutter wall therebetween; and a flexible tubular element connected at opposite ends respectively to said supply manifold and the other end of said male member.

4. The apparatus as claimed in claim 3 wherein the axis of said tubular male member is arranged at an angle relative to the plane containing said external flange.

5. The apparatus as claimed in claim 3 wherein said external flange is provided with an eliptical orifice forming the outlet end of said tubular male member.

6. The apparatus as claimed in claim 3 wherein the said opposite end of said female member terminates in a face lying in a plane which is inclined relative to the plane containing said internal flange. a

7. The apparatus as claimed in claim 3 wherein said female member is provided with serrations which are adapted to be engaged by serrations on said locking member when the latter is tightened.

8. The apparatus as claimed in claim 3 wherein the opposite end of said male member is adapted for axial insertion into said flexible tubular element.

9. An inlet fitting for use at an opening in the submerged portion of a wall surrounding a swimming pool, said fitting comprising an elongated tubular male member having an external flange at one end thereof which is adapted to surround said opening and to contact the exterior surface of said wall, the axis of said tubular male member being arranged at an angle relative to the plane containing said external flange, the said male member being adapted to protrude through said opening; a female member slidably received on said male member, said female member having an internal flange at one end thereof which is adapted to surround said opening and to contact the interior surface of said wall; and, a locking member threaded onto said male member and engageable with said female member, said locking member being operative on said male and female members to urge said external and internal flanges together to grip said wall therebetween.

* * * * *